US012708208B2

(12) United States Patent
Ding et al.

(10) Patent No.: US 12,708,208 B2
(45) Date of Patent: Aug. 18, 2026

(54) BASE AND ASSEMBLY SOFA

(71) Applicant: ANJI LONGWIN FURNITURE CO. LTD., Huzhou (CN)

(72) Inventors: Chen Ding, Huzhou (CN); Chenlu Pan, Huzhou (CN); Zhongjian Huang, Huzhou (CN)

(73) Assignee: ANJI LONGWIN FURNITURE CO. LTD., Huzhou (CN)

( * ) Notice: Subject to any disclaimer, the term of this patent is extended or adjusted under 35 U.S.C. 154(b) by 1014 days.

(21) Appl. No.: 17/910,410

(22) PCT Filed: Aug. 16, 2022

(86) PCT No.: PCT/CN2022/112766

§ 371 (c)(1),
(2) Date: Jan. 11, 2024

(87) PCT Pub. No.: WO2024/007420

PCT Pub. Date: Jan. 11, 2024

(65) Prior Publication Data

US 2024/0206625 A1 Jun. 27, 2024

(30) Foreign Application Priority Data

Jul. 7, 2022 (CN) ..... 202210793948.1

(51) Int. Cl.
*A47C 4/02* (2006.01)

(52) U.S. Cl.
CPC ..... *A47C 4/021* (2013.01); *A47C 4/028* (2013.01)

(58) Field of Classification Search
CPC ..... A47C 4/021; A47C 4/02; A47C 13/005
See application file for complete search history.

(56) References Cited

U.S. PATENT DOCUMENTS 4,651,363 A * 3/1987 Mizelle ..... A47C 17/175 297/440.22
5,314,234 A * 5/1994 England ..... A47C 7/624 5/52

(Continued)

FOREIGN PATENT DOCUMENTS

CN 201916312 U * 8/2011
CN 111173815 A * 5/2020 ..... F16B 5/10

(Continued)

*Primary Examiner* — Timothy J Brindley
(74) *Attorney, Agent, or Firm* — Olive Law Group, PLLC

(57) ABSTRACT

The present disclosure discloses a base, including a front frame element, front seat connectors arranged at left and right ends of the front frame element, two side frame elements with a preset interval, and side seat front connectors arranged on the side frame elements and suitable for being connected to the front seat connectors; each side seat front connector is provided with an assembly base surface; positioning units are arranged on the assembly base surfaces; each front seat connector is provided with an assembly fitting surface making contact with the corresponding assembly base surface; positioning cutoffs for limiting final assembly positions of the front seat connectors on the side seat front connectors are arranged on the assembly fitting surfaces; and first guiding pathways and second guiding pathways for guiding the positioning units to reach the positioning cutoffs in a first assembly direction and a second assembly direction are arranged on the assembly fitting surfaces. The present disclosure further discloses an assembly sofa with the base. The present disclosure has the beneficial effects of being convenient to assemble and highly firm and stable after being assembled.

13 Claims, 11 Drawing Sheets

(56) References Cited

U.S. PATENT DOCUMENTS

| | | | | |
|---|---|---|---|---|
| 6,758,450 | B2 * | 7/2004 | Niederman | A47C 13/005 297/440.16 |
| 8,356,954 | B2 * | 1/2013 | Koch | A47C 4/028 403/360 |
| 10,519,997 | B2 * | 12/2019 | Stauss | A47C 17/86 |
| 11,426,004 | B1 * | 8/2022 | Aubé | A47C 13/005 |
| 11,464,339 | B2 * | 10/2022 | Milberg | A47C 4/021 |
| 11,484,122 | B2 * | 11/2022 | Chen | A47C 17/02 |
| 11,647,841 | B2 * | 5/2023 | Aubé | A47C 4/028 297/440.14 |
| 12,016,461 | B2 * | 6/2024 | Ha | A47C 17/02 |
| 2025/0160523 | A1 * | 5/2025 | Milberg | A47C 4/021 |

FOREIGN PATENT DOCUMENTS

| | | | | | |
|---|---|---|---|---|---|
| CN | 215604406 | U | * | 1/2022 | |
| CN | 116292560 | A | * | 6/2023 | A47B 87/005 |
| DE | 202019100109 | U1 | * | 4/2020 | A47C 4/028 |
| WO | WO-2017123180 | A1 | * | 7/2017 | A47C 7/00 |
| WO | WO-2021080534 | A1 | * | 4/2021 | A47C 4/028 |

* cited by examiner

BASE AND ASSEMBLY SOFA

CROSS REFERENCE TO RELATED APPLICATIONS

This is a U.S. national stage patent application that claims priority to and the benefit of PCT International Patent Application No. PCT/CN2022/112766, filed on Aug. 16, 2022, which claims priority to and the benefit of Chinese Patent Application No. 2022107939481, filed on Jul. 6, 2022; the disclosures of which are incorporated by reference herein in their entireties.

TECHNICAL FIELD

The present disclosure relates to a base and an assembly sofa, which are suitable for the technical field of furniture.

BACKGROUND ART

Seating devices or beds such as chairs, sofas and beds are all provided with bases with basically the same structures. As foundation structures at bottoms of the seating devices or the beds, each base basically includes two spaced side frame elements, and a front seat connected to front ends of the two side frame elements, and backrests, seat boards, bed boards and the like are arranged based on the bases to form the seating devices or the beds.

For example, patent application with the publication number: CN102984972B in the prior art discloses a bed-to-sofa conversion frame, including a backrest, a footer (optional) and a pair of armrests which are to be connected as a solid unit and or assembled together to form a sofa frame around a traditional bed and a bed frame thereof. The pair of armrests form a pedestal used for installing the backrest and the footer through corresponding installation fasteners and installation grooves. The backrest and the feet both can be integrated units or assemblies and/or can be folded, so as to achieve simple storage. In the bed-to-sofa conversion frame of the patent application, an inner side of a front bottom of the left armrest may include connectors, such as installation fasteners or supports with installation grooves, and the connectors are suitable for being connected with connectors on the footer, such as corresponding installation supports and grooves of the feet. Although this connection and assembly manner facilitates assembly, its firmness and stability are relatively low, easily resulting in looseness and even separation.

SUMMARY

The technical problem to be solved by the present disclosure is to provide a base and an assembly sofa. The base and the assembly sofa are convenient to assemble and highly firm and stable after being assembled.

The base and the assembly sofa of the present disclosure are achieved through the following technical solutions.

A base, includes a front frame elements, front seat connectors arranged at left and right ends of the front frame elements, two side frame elements with a preset interval, and side seat front connectors arranged on the side frame elements and suitable for being connected to the front seat connectors;

each side seat front connector is provided with an assembly base surface; positioning units are arranged on the assembly base surfaces;

each front seat connector is provided with an assembly fitting surface making contact with the corresponding assembly base surface, and extrusion strength generated by contact is limited by the preset interval; positioning cutoffs for limiting final assembly positions of the front seat connectors on the side seat front connectors are arranged on the assembly fitting surfaces; and first guiding pathways and second guiding pathways for guiding the positioning units to reach the positioning cutoffs in a first assembly direction and a second assembly direction are arranged on the assembly fitting surfaces.

As a further improvement of the present disclosure, circuitous pathways for guiding the positioning units to reach the second guiding pathways from the first guiding pathways in a circuitous assembly direction are arranged on the assembly fitting surfaces.

As a further improvement of the present disclosure, the circuitous pathways are provided with circuitous inflection points, and circuitous pathway front sections and circuitous pathway rear sections are limited by the circuitous inflection points as boundaries; and the circuitous assembly direction corresponding to the circuitous pathway rear sections is consistent with the second assembly direction.

As a further improvement of the present disclosure, attaching walls completely attached to part of surfaces of the positioning units when the positioning units reach the circuitous inflection points are formed at the circuitous inflection points.

As a further improvement of the present disclosure, a first assembly path limited by the first guiding pathways and the second guiding pathways and a second assembly path limited by the first guiding pathways, the circuitous pathways and the second guiding pathways coexist side by side.

As a further improvement of the present disclosure, curbs formed at least on sides of the first guiding pathways, the circuitous pathways and the second guiding pathways are arranged on the front seat connectors; and self-locking structures capable of abutting against the curbs and used for preventing the front seat connectors from being separated from the side seat front connectors are arranged on the positioning units.

As a further improvement of the present disclosure, locking units which have preset shapes and can retract after being extruded are arranged on the assembly base surfaces; and locking cutoffs which allow the locking units extruded by the assembly fitting surfaces to rebound to the preset shapes and are combined with the locking units are arranged on the assembly fitting surfaces.

As a further improvement of the present disclosure, the locking cutoffs include encircling walls formed on the assembly fitting surfaces, and rebound spaces which are limited in the encircling walls and allow the locking units to rebound to the preset shapes; and the encircling walls abut against the locking units at least in a direction opposite to the second assembly direction.

As a further improvement of the present disclosure, the locking units include combinations presented as preset shapes, and extension bodies which extend out of the combinations and penetrate through the side seat front connectors; each side seat front connector is provided with an assembly bottom surface opposite to the corresponding assembly base surface, and the extension bodies are provided with abutting-against structures capable of making contact with the assembly bottom surfaces, so as to completely show the combinations on the assembly base surfaces; and supporting base portions are arranged on sides, positioned on the assembly bottom surfaces, of the side seat front connectors, elastic units which are arranged in a retraction direction of the locking units and have an elastic compression amount are arranged on the supporting base portions, and the elastic units support the abutting-against structures or the extension bodies to make the abutting-against structures kept in a state of making contact with the assembly bottom surfaces.

As a further improvement of the present disclosure, the elastic units are arranged as springs, and their two ends are supported on the supporting base portions, the abutting-against structures or the extension bodies respectively.

As a further improvement of the present disclosure, the elastic units are arranged as sheet members which are bent to form two parts, one part of each of the sheet members is supported on the corresponding supporting base portion, and the other part supports or is connected with the corresponding extension body.

As a further improvement of the present disclosure, the side seat front connectors are positioned on inner surfaces of the side frame elements; and the front seat connectors include front frame element connector fixing portions and front seat connector assembly portions connected with the front seat connector fixing portions, the front seat connector fixing portions are positioned on an inner surface of the front frame element, and the assembly fitting surfaces are formed on the front seat connector assembly portions.

An assembly sofa, includes the base, a backrest, backrest connectors arranged on left and right sides of the backrest, side seat rear connectors arranged on side frame elements and suitable for being connected to the backrest connectors, a seat board, seat board connectors arranged on left and right sides of the seat board, and side seat middle connectors arranged on the side frame elements and suitable for being connected to the seat board connectors.

As a further improvement of the present disclosure, the side seat rear connectors are provided with assembly slots providing an assembly guiding direction, and the assembly slots include sliding portions and locking portions in the assembly guiding direction; and the backrest connectors are provided with inserting units inserted into the assembly slots in the assembly guiding direction, and the inserting units are in clearance fit with the sliding portions and in interference fit with the locking portions.

As a further improvement of the present disclosure, fit clearances of the assembly slots and the inserting units are gradually reduced in the assembly guiding direction.

As a further improvement of the present disclosure, the side seat middle connectors are provided with bearing structures; and the seat board connectors are provided with supporting structures supported on the bearing structures.

As a further improvement of the present disclosure, each side seat middle connector includes two bearing side portions which are positioned on inner surfaces of the side frame elements and extend outwards, and a positioning portion connecting the two bearing side portions and forming a clearance with the inner surfaces of the side frame elements; each seat board connector includes two supporting side portions which are positioned on side faces of the seat board and extend outwards; one supporting structure and one bearing structure are formed by the two supporting side portions and the two bearing side portions respectively, and the two supporting side portions are supported on the two corresponding bearing side portions respectively; and two sides of the positioning portion abut against the two supporting side portions respectively to limit an assembly position of the seat board connector on the side seat middle connector.

As a further improvement of the present disclosure, each seat board connector further includes a connecting portion connecting the two supporting side portions, and the two supporting side portions and the connecting portion are buckled on the positioning portion.

As a further improvement of the present disclosure, bearing units are arranged on the inner surface of the front frame element, and a front portion of the seat board is supported on the bearing units.

As a further improvement of the present disclosure, the assembly sofa further includes at least one seat cushion laid on the seat board, and at least one backrest cushion against the backrest; and the seat cushions and the backrest cushions are stored in vacuum compression packages before the assembly sofa is assembled.

The present disclosure has the following beneficial effects:

According to the base provided by the present disclosure, the connected and assembled front seat connectors and side seat front connectors can stably and firmly keep the structure of the base, looseness caused by human factors or aging of parts can be avoided or relieved, an assembly mode without tools and parts can be achieved, and the base is suitable for being rapidly and conveniently assembled; and the assembly sofa provided by the present disclosure is also suitable for being rapidly and conveniently assembled, the stability and firmness of the assembled structure are reliable, and meanwhile, a packaging space is easily compressed before assembly, so as to achieve the advantage of saving the transportation cost.

BRIEF DESCRIPTION OF THE DRAWINGS

Preferred embodiments in the present disclosure will be described in detail below with reference to accompanying drawings, so as to facilitate understanding of objectives and advantages of the present disclosure, wherein.

DETAILED DESCRIPTION OF THE EMBODIMENTS

The present disclosure will be further explained in detail below with reference to the accompanying drawings and the embodiments.

Direction terms, such as upper, lower, left, right, front, rear, front side, back side, top and bottom, which are mentioned or may be mentioned in the specification, are defined relative to structures shown in each accompanying drawing. Words "inside" and "outside" refer to directions facing or keeping away from geometric centers of specific components respectively, which are relative in meaning, and therefore corresponding changes may be made according to different positions where the components are positioned, and different using states of the components. Therefore, these terms or other direction terms should not be explained as restrictive terms.

Figure 1:
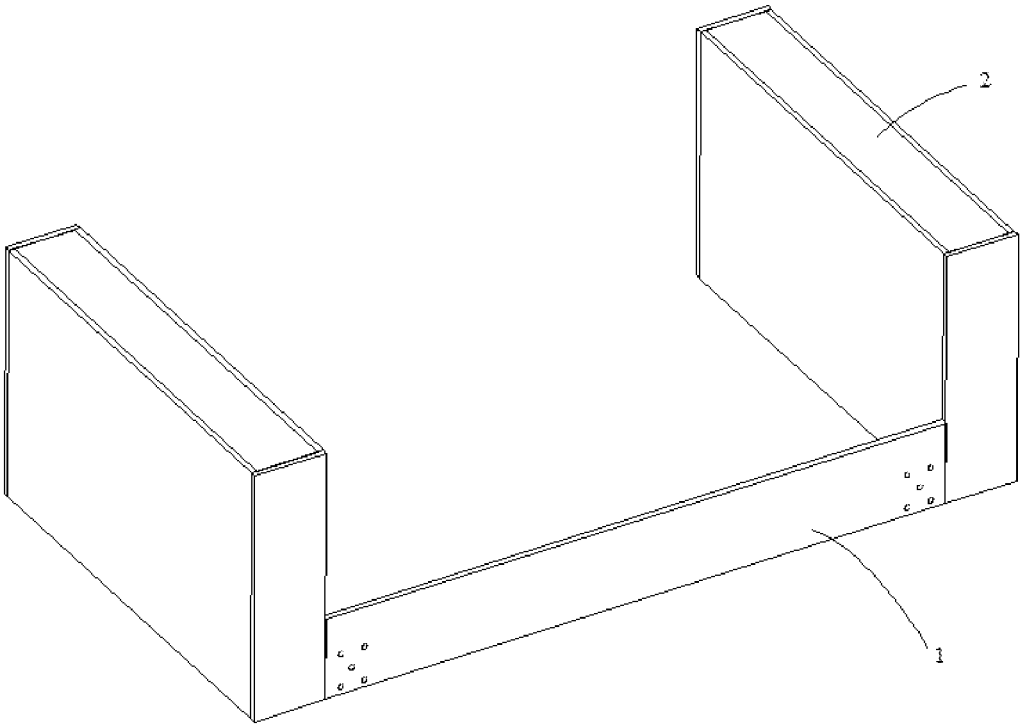
FIG. 1 is a structural schematic diagram of a base according to the present disclosure in one view.
Figure 2:
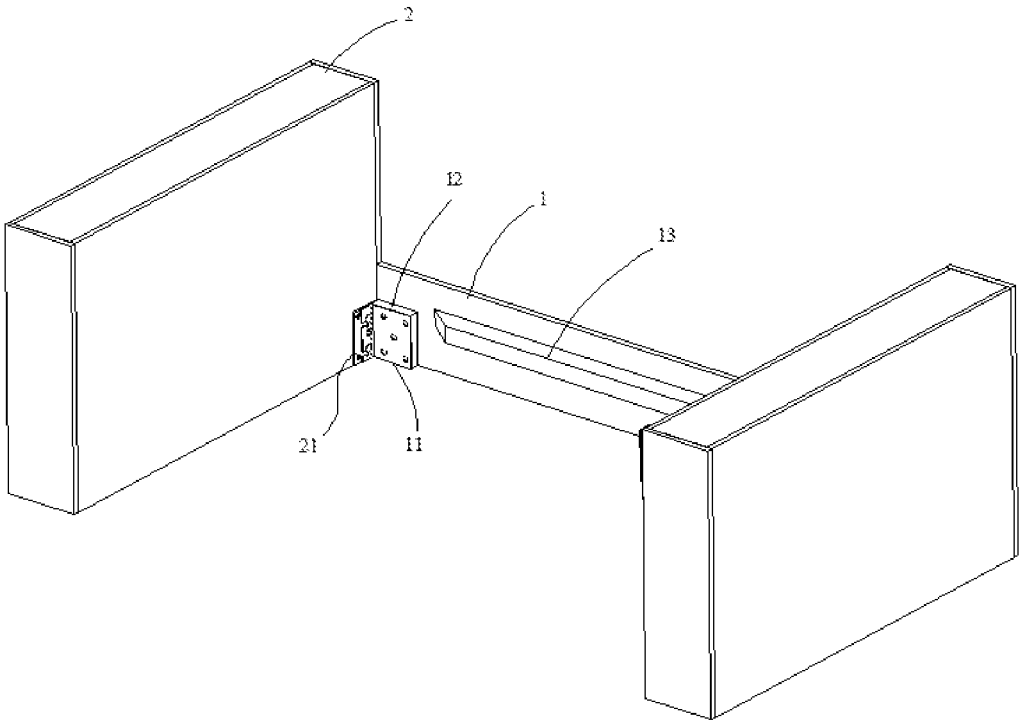
FIG. 2 is a schematic structural diagram of a base according to the present invention in another view.
Figure 3:
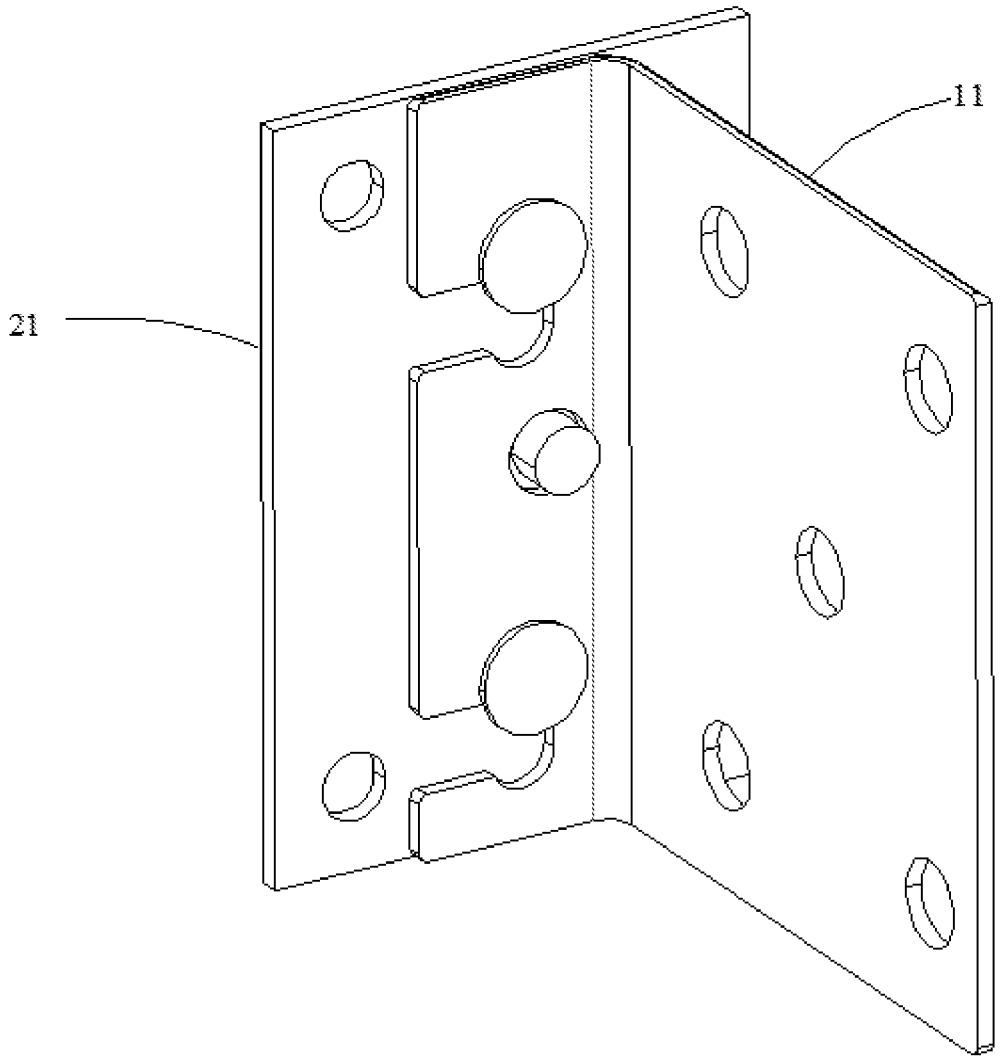
FIG. 3 is a stereoscopic schematic diagram of a front seat connector and a side seat front connector which are assembled according to the present disclosure.
Figure 4:
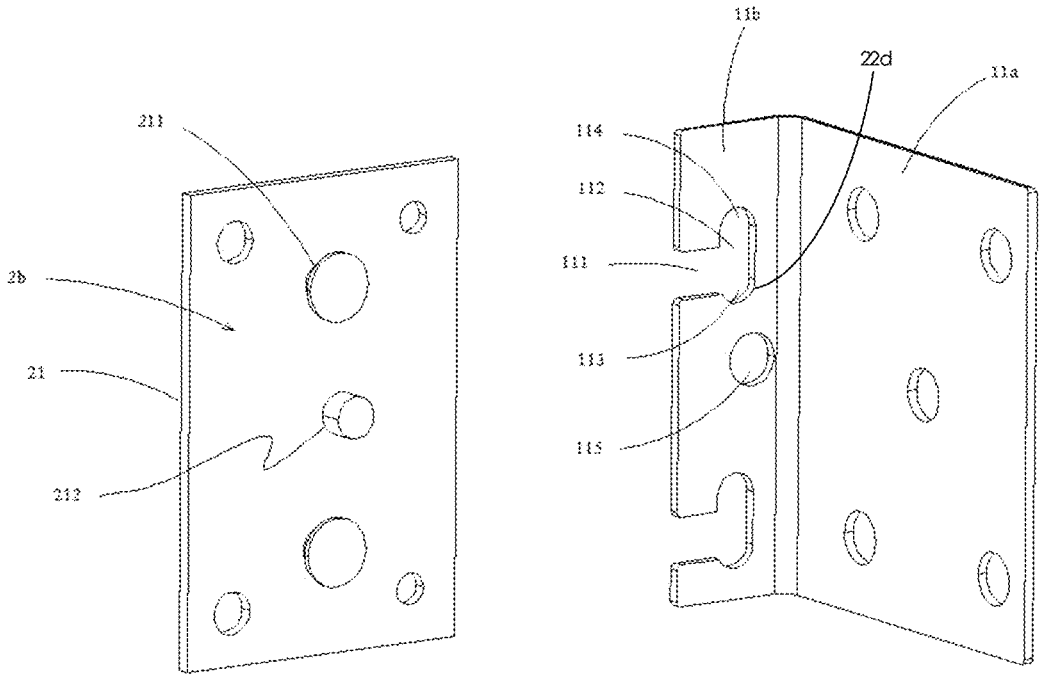
FIG. 4 is a structural schematic diagram of a front seat connector and a side seat front connector according to the present disclosure before assembly in one view.
Figure 5:
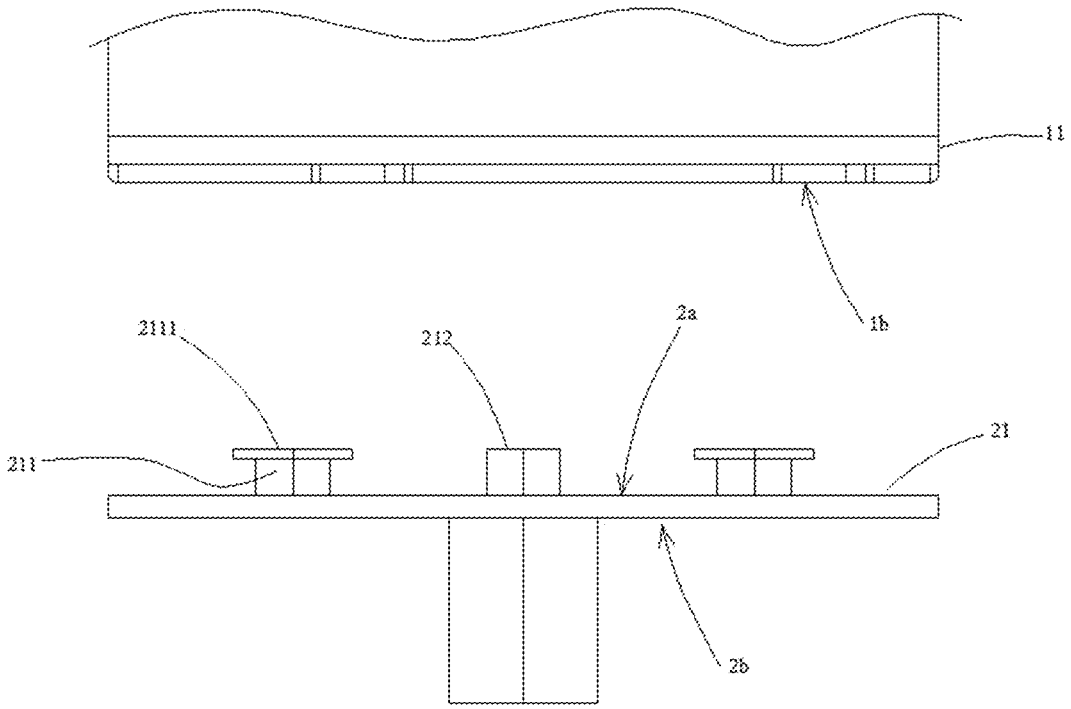
FIG. 5 is a structural schematic diagram of a front seat connector and a side seat front connector according to the present disclosure before assembly in another view.
Figure 6:
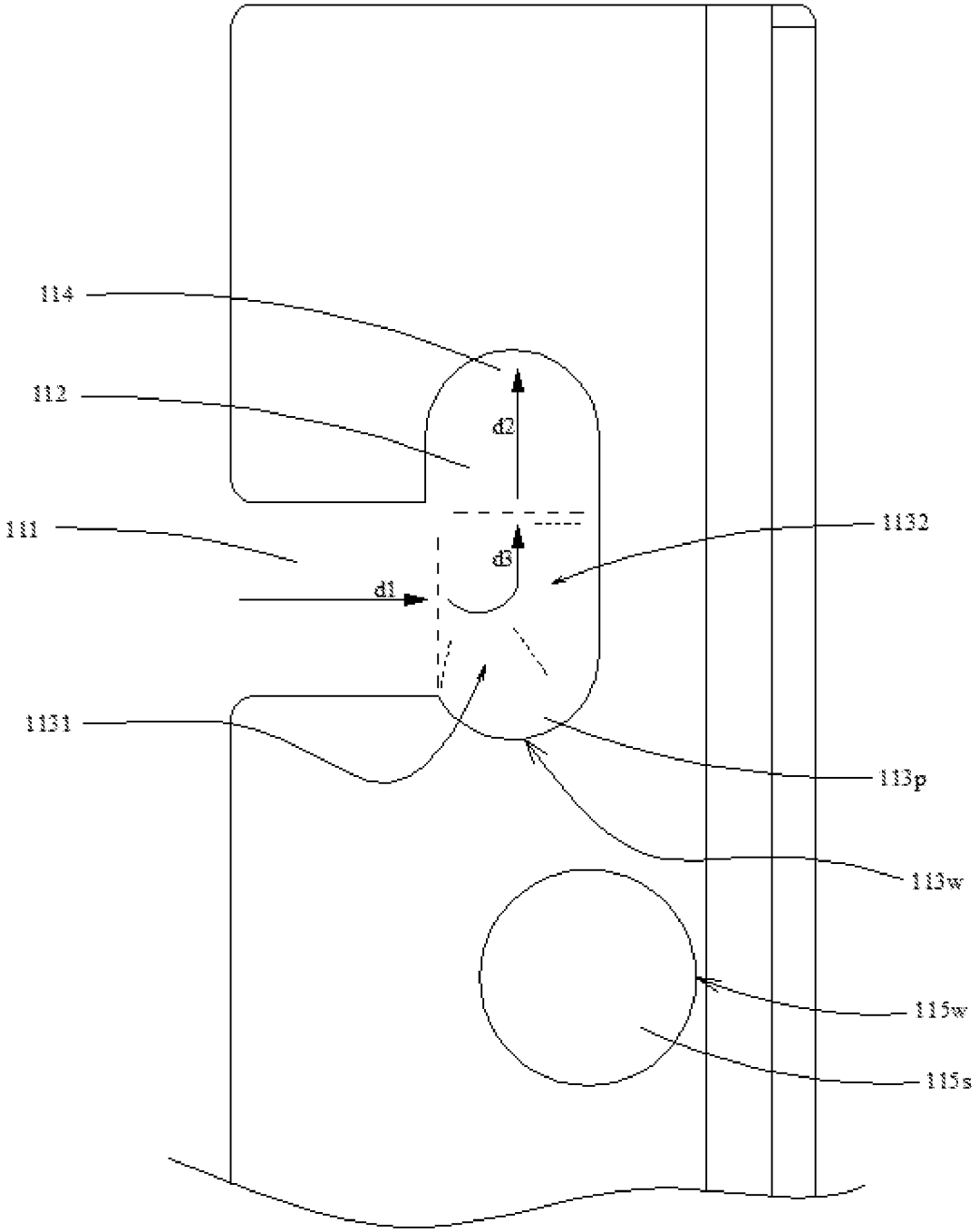
FIG. 6 is a structural schematic diagram of a first guiding pathway, a second guiding pathway, a circuitous pathway, a positioning cutoff and a locking cutoff shown by a front seat connector according to the present disclosure.

A base, as shown in FIG. 1 and FIG. 2, includes a front frame element 1 and two side frame elements 2 connected to left and right ends of the front frame element 1 respectively, and the base serves as a bottom foundation structure of a seating device or a bed. In one embodiment, the base serves as a bottom foundation structure of a chair, and a chair back and a seat are arranged based on the base. In another embodiment, the base serves as a bottom foundation structure of a single-seat sofa or a multi-seat sofa, a backrest and a seat board are arranged based on the base, or backrest cushions and seat cushions are additionally arranged. In other embodiments, the base serves as a bottom foundation structure of a bed, and a headboard and a bed board are arranged based on the base.

The base shown in the present application is easy to assemble, disassemble, package and store flexibly. Front seat connectors 11 are arranged at the left and the right ends of the front frame element 1 respectively, and side seat front connectors 21 suitable for being connected to the front seat connectors 11 are arranged on the side frame elements 2. A preset interval is formed between the two side frame elements 2, which is limited by widths of the chair, the sofa, the bed or other seats and beds with the base. Moreover, when the chair, the sofa, the bed or other seating devices or beds are assembled, usually, the chair back, the backrest, the headboard or other structures are connected with the two side seats 2 first, and then the front seat connectors 11 at the left and the right ends of the front frame element 1 are assembled and connected to the corresponding side seat front connectors 21.

Referring to FIG. 3-FIG. 6, each side seat front connector 21 is provided with an assembly base surface 2*a* which is a plane basically. Positioning units 211 are formed on the assembly base surfaces 2*a*, which are components with structural shapes. The positioning units can be integrally formed on the assembly base surfaces 2*a*, and can also be fixedly connected to the assembly base surfaces 2*a* by welding or fasteners. Each front seat connector 11 is provided with an assembly fitting surface 1*b* which is a planes basically. When and after the front seat connectors 11 and the side seat front connectors 21 are assembled and connected, the assembly fitting surfaces 1*b* and the assembly base surfaces 2*a* are kept in contact with each other all the time, and mutual extrusion strength generated by contact between them is limited by the preset interval. The assembly base surfaces 2*a* and the assembly fitting surfaces 1*b* may relatively slide during connection and assembly, so that the magnitude of friction force generated between them is proportional to the mutual extrusion strength. Positioning cutoffs 114 are arranged on the assembly fitting surfaces 1*b*, and limit final assembly positions of the front seat connectors 11 on the side seat front connectors 21, that is, positions of the positioning units 211 on the assembly base surfaces 2*a* are limited at the positioning cutoffs 114 after assembly is completed. First guiding pathways 111 and second guiding pathways 112 for guiding the positioning units 211 to reach the positioning cutoffs 114 in a first assembly direction d1 and a second assembly direction d2 are arranged on the assembly fitting surfaces 1*b*. The first assembly direction d1 and the second assembly direction d2 are two different directions, which are linear directions basically, with a slight radian allowable. An extension direction of each of the first guiding pathways 111 is matched with the first assembly direction d1, and an extension direction of each of the second guiding pathways 112 is matched with the second assembly direction d2.

When the front seat connectors 11 and the side seat front connectors 21 are assembled and connected, firstly the assembly base surfaces 2*a* of the front seat connectors 11 are attached to the assembly fitting surfaces 1*b* of the side seat front connectors 21, so that the positioning units 211 are positioned on the first guiding pathways 111; then the front seat connectors 11 slide in the first assembly direction d1, so that the positioning units 211 slide along the first guiding pathways 111; then the front seat connectors 11 slide in the second assembly direction d2, so that the positioning units 211 slide along the second guiding pathways 112; and finally the positioning units 211 reach the positioning cutoffs 114.

Installation positions of the positioning units 211 are limited by the first guiding pathways 111, the second guiding pathways 112 and the positioning cutoffs 114, so that an assembly operation mode of the front seat connectors 11 and the side seat front connectors 21 without tools and parts can be achieved; and only assembly and connection in the first assembly direction d1 and the second assembly direction d2 are needed, so that the front seat connectors and the side seat front connectors are suitable for being rapidly and conveniently assembled. After assembly is completed, the front frame element 1 is easily kicked or hit by feet of a user, resulting in relative sliding between the assembly base surfaces 2*a* and the assembly fitting surfaces 1*b*, so that the positioning units 211 disengage from the positioning cutoffs 114 and slide to the second guiding pathways 112. Although the positioning units 211 disengage from the positioning cutoffs 114, the positioning units hardly escape from the second guiding pathways 112 to the first guiding pathways 111 to finally make the front seat connectors 11 separated from the side seat front connectors 21 due to a difference between the first guiding pathways 111 and the second guiding pathways 112 in extension directions and friction force generated by relative sliding between the assembly base surfaces 2*a* and the assembly fitting surfaces 1*b*. In addition, by arranging the first guiding pathways 111 and the second guiding pathways 112 on the assembly fitting surfaces 1*b*, a total length of a path from the positioning units 211 to the positioning cutoffs 114 is increased, thereby increasing the escape difficulty of the positioning units 211.

Theoretically, the preset interval between the two side frame elements 2 needs to be slightly less than a length of each of the side frame elements 2, so that the front seat connectors 11 and the side seat front connectors 21 are assembled in a close fit manner, thereby improving the compactness of the assembled base and preventing the base from loosening. However, in many cases, the preset interval may be less than a theoretical value due to limitations of production and machining precision and part tolerances, which increases an assembly close-fit degree of the front seat connectors 11 and the side seat front connectors 21, that is, extrusion strength and friction force between the assembly base surfaces 2*a* and the assembly fitting surfaces 1*b* are high, so that it may take a lot of efforts to implement manual assembly. As the user pushes the front frame element 1 from outside to inside during assembly, the user cannot well observe a real-time assembly condition of the front seat connectors 11 and the side seat front connectors 21 due to a limited visual field.

The user pushes the front seat connectors 11 in the first assembly direction d1 to slide the positioning units 211 to intersections of the first guiding pathways 111 and the second guiding pathways 112, and then pushes the front seat connectors 11 in the second assembly direction d2. If force is not continuously applied when the user pushes the front seat connectors 11 in the first assembly direction d1, the positioning units 211 may bring to a standstill during advancing, the positioning units 211 may not be pushed due to high static friction force when pushed again, and at this moment, the user cannot accurately judge a reason for being incapable of pushing the positioning units 211 lies in the static friction force or a situation that the positioning units 211 are pushed to ends of the first guiding pathways 111, resulting in causing misjudgment easily. Due to misjudgment, assembly cannot be completed when the user pushes the front seat connectors 11 in the second assembly direction d2, and the positioning units 211 and the first guiding pathways 111 may also be damaged when the user pushes the front seat connectors 11 in the second assembly direction d2.

Based on this, circuitous pathways 113 are arranged on the assembly fitting surfaces 1*b*, and guide the positioning units 211 to reach the second guiding pathways 112 from the first guiding pathways 111 in a circuitous assembly direction d3. The circuitous pathways 113 are used to connect the first guiding pathways 111 and the second guiding pathways 112, so that the first assembly direction d1, the circuitous assembly direction d3 and the second assembly direction d2 are continuously connected. The first assembly direction d1 and the second assembly direction d2 are linear directions basically, and the circuitous assembly direction d3 is an arc direction; and correspondingly, the first guiding pathways 111 and the second guiding pathways 112 are in linear extension trends basically, and the circuitous pathways 113 are in an arc extension trend basically.

The circuitous pathways 113 are provided with circuitous inflection points 113*p* positioned on middle sections of the circuitous pathways 113, and circuitous pathway front sections 1131 and circuitous pathway rear sections 1132 are limited by the circuitous inflection points 113*p* of the circuitous pathways 113 as boundaries. The circuitous pathway front sections 1131 are arc-shaped sections, the circuitous pathway rear sections 1132 are linear sections basically, and the circuitous assembly direction d3 corresponding to the circuitous pathway rear sections 1132 is consistent with the second assembly direction d2. Direction consistency here means that the circuitous assembly direction d3 of the sections is basically consistent with the second assembly direction d2, and actually, the circuitous assembly direction d3 of the sections is an arc direction with a small radian while the circuitous assembly direction d3 corresponding to the circuitous pathways 113 front sections is an arc direction with a large radian.

When the user pushes the front seat connectors 11 in the first assembly direction d1, the positioning units 211 can smoothly slide from the first guiding pathways 111 to the circuitous pathway front sections 1131 as directions of the first guiding pathways 111 and the circuitous pathway front sections 1131 are continuous. The corresponding circuitous assembly direction d3 is the arc direction when the positioning units 211 slide on the circuitous pathway front sections 1131, which can be obviously sensed by the user, and a corresponding prompting effect may be achieved, so that the user prejudges that the positioning units 211 are about to reach the circuitous inflection points 113*p*, so as to prevent user's misjudgment.

Attaching walls 113*w* are formed at the circuitous inflection points 113*p*, and completely attached to surfaces of the positioning units 211 when the positioning units 211 reach the circuitous inflection points 113*p*, so that the positioning units 211 are accurately positioned at the circuitous inflection points 113*p*, so as to be matched with the precision of the positioning units 211 entering the circuitous pathway rear sections 1132.

Under a condition that the preset interval is close to the theoretical value, the friction force between the assembly base surfaces 2*a* and the assembly fitting surfaces 1*b* is appropriate, and thus, it is appropriate to assemble the positioning units 211 through the first guiding pathways 111 and the second guiding pathways 112. Under a condition that the preset interval is obviously less than the theoretical value, it is appropriate to assemble the positioning units 211 approximately complete assembly through the first guiding pathways 111, the circuitous pathways 113 and the second guiding pathways 112. Thus, the two manners need to coexist side by side, that is, first assembly paths limited by the first guiding pathways 111 and the second guiding pathways 112 and second assembly paths limited by the first guiding pathways 111, the circuitous pathways 113 and the second guiding pathways 112 coexist side by side.

A structure of the base may loosen due to aging of parts after the base is used for a long time, the front seat connectors 11 may be separated from the side seat front connectors 21, that is, a state between the assembly base surfaces 2*a* and the assembly fitting surfaces 1*b* is changed from close fitting by extrusion to mutual separation, resulting in the further aggravation of a looseness degree between the front frame element 1 and the side frame elements 2. Thus, curbs 11*c* formed at least on ides of the first guiding pathways 111, the circuitous pathways 113 and the second guiding pathways 112 are arranged on the front seat connectors 11, and self-locking structures 2111 are arranged on the positioning units 211, and can abut against the curbs 11*c* to prevent the front seat connectors 11 from being separated from the side seat front connectors 21, so at least the assembly base surfaces 2*a* and the assembly fitting surfaces 1*b* can be kept in a contact state. The front seat connectors 11 and the side seat front connectors 21 are kept in an assembly state, so that at least loosening connection between the front frame element 1 and the side frame elements 2 can be avoided easily.

In one embodiment, the front seat connectors 11 are provided with laminated structures, one surface of each laminated structure is the assembly fitting surface 1*b*, and the first guiding pathways 111, the second guiding pathways 112 and the circuitous pathways 113 are arranged as linear grooves formed in the laminated structures. The positioning units 211 are arranged as columnar structures which are formed by protruding out of the assembly base surfaces 2*a* and penetrate through the linear grooves, the self-locking structures 2111 are arranged as cap structures which are formed on the columnar structures and extend radially, and the curbs 11*c* are formed on portions, against which the cap structures abut, along one side or two sides of each of the linear grooves, of the other surfaces of the laminated structures.

Locking units 212 which have preset shapes and can retract after being extruded are arranged on the assembly base surfaces 2*a*, and the locking units 212 can be kept in their preset shapes in a non-force-bearing state, and retract when suffering from acting force pressed onto the assembly base surfaces 2*a*, so that the assembly base surfaces 2*a* are kept as planes. Locking cutoffs 115 are arranged on the assembly fitting surfaces 1*b*, and independently formed on the assembly fitting surfaces 1*b*. When the positioning units 211 pass through the first guiding pathways 111 and the second guiding pathways 112, the locking units 212 retract due to mutual extrusion of the assembly base surfaces 2*a* and the assembly fitting surfaces 1*b*, and when the positioning units 211 reach the positioning cutoffs 114, namely final assembly positions of the front seat connectors 11 on the side seat front connectors 21, the locking units 212 reach the locking cutoffs 115, rebound to the preset shapes, and are combined with the locking cutoffs 115. Due to mutual combination of the locking cutoffs 115 and the locking units 212, the front seat connectors 11 cannot slide relative to the side seat front connectors 21 when assembly is completed. Although the front frame element 1 is kicked or hit by the feet of the user, the positioning units 211 still cannot disengage from the positioning cutoffs 114. This locking manner mainly depends on the property that the locking units 212 are kept in the preset shapes, however, if the locking units 212 are aged or damaged after long-time use so that they cannot be kept in the preset shapes, the locking units 212 may not be kept in a state of combination with the locking cutoffs 115. In this case, when kicked or hit by the user, the front seat connectors 11 may slide relative to the side seat front connectors 21, and at this moment, the front seat connectors 11 are prevented from being separated from the side seat front connectors 21 due to the arrangement of the first guiding pathways 111 and the second guiding pathways 112.

More specifically, the locking cutoffs 115 include encircling walls 115*w* formed on the assembly fitting surfaces 1*b*, and rebound spaces 115*s* which are limited in the encircling walls 115*w* and allow the locking units 212 to rebound to the preset shapes. When the locking units 212 reach the rebound spaces 115*s* of the locking cutoffs 115, the locking units 212 are freely released from a constraint state where the locking units are extruded by the assembly fitting surfaces 1*b*, that is, the locking units restore to the preset shapes due to their rebound properties. The encircling walls 115*w* block the locking units 212 restoring to the preset shapes, and abut against the locking units 212 at least in a direction opposite to the second assembly direction d2, so that the locking units 212 are prevented from returning along an original path, and the front seat connectors 11 and the side seat front connectors 21 are locked at the final assembly positions. In one embodiment, the positioning cutoffs 114 are presented as through holes penetrating through the front seat connectors 11, the encircling walls 115*w* are formed by walls of the through holes, and the rebound spaces 115*s* are formed by spaces where the locking units 212 are made readily accessible to penetration with the through holes.

More specifically, the locking units 212 include combinations 2121 presented as preset shapes, and extension bodies 2122 which extend out of the combinations 2121 and penetrate through the front seat connectors 11. When the locking units 212 are not extruded by the assembly fitting surfaces 1*b*, the combinations 2121 are portions with preset shapes, formed on the assembly base surfaces 2*a*, of the locking units 212, and the combinations 2121 are of columnar structures basically. The property that the locking units 212 retract after being extruded is achieved by moving the combinations 2121 and the extension bodies 2122 in a direction where both of them penetrate through the front seat connectors 11. Each side seat front connector 21 is provided with an assembly bottom surface 2*b* opposite to the corresponding assembly base surface 2*a*, and the extension bodies 2122 are provided with abutting-against structures 2123 capable of making contact with the assembly bottom surfaces 2*b*. Under a condition that the abutting-against structures 2123 abut against the assembly bottom surfaces 2*b*, the combinations 2121 can be completely shown on the assembly base surfaces 2*a*, that is, the preset shapes of the locking units 212 on the assembly base surfaces 2*a* are shown. Supporting base portions 2*c* are arranged on sides, positioned on the assembly bottom surfaces 2*b*, of the side seat front connectors 21, and the supporting base portions 2*c* may be part of the side frame elements seats 2, and may also be part of the side seat front connectors 21. Elastic units 2124 are arranged on the supporting base portions 2*c*, have an elastic compression amount in retraction directions of the locking units 212, and are in a compressed state when the combinations 2121 are not extruded by the assembly fitting surfaces 1*b*, in which elastic acting force is applied to the abutting-against structures 2123 or the extension bodies 2122, so as to provide supporting to make the abutting-against structures 2123 kept in a state of making contact with the assembly bottom surfaces 2*b*. When the combinations 2121 are extruded by the assembly fitting surfaces 1*b*, the combinations 2121 and the extension bodies 2122 move towards the supporting base portions 2*c*, and the compression amount of the elastic units 2124 is increased. When the locking units 212 reach the locking cutoffs 115, the elastic force applied by the elastic units 2124 makes the abutting-against structures 2123 abut against the assembly bottom surfaces 2*b* and kept in this state, so that the combinations 2121 with the preset shapes are completely shown on the assembly bottom surfaces 2*b*.

Figure 7:
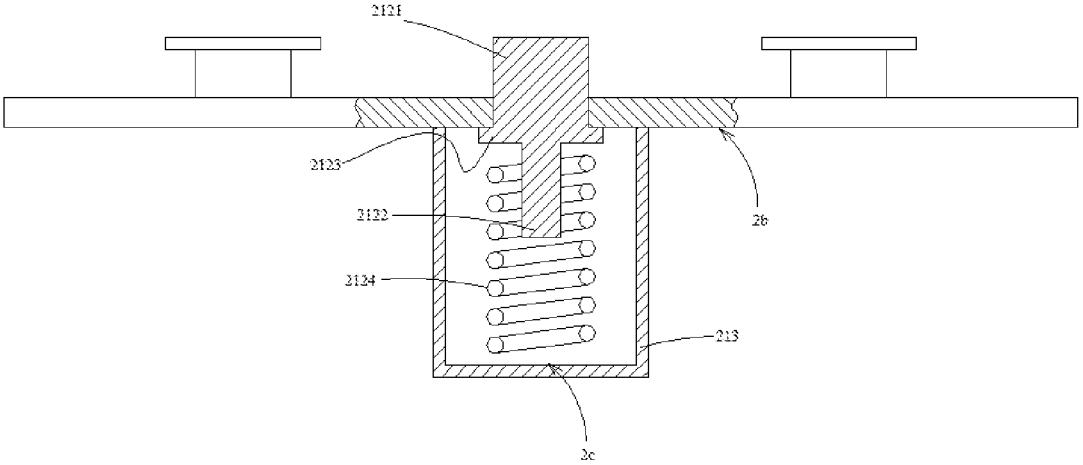
FIG. 7 is a sectional schematic diagram of a locking unit in one embodiment according to the present disclosure.

In one embodiment, referring to FIG. 7, the elastic units 2124 are arranged as springs, one end of each spring is supported on the corresponding supporting base portion 2*c*, and the other end is supported on the corresponding abutting-against structure 2123 or the corresponding extension body 2122. In the embodiment, hollow shells 213 are arranged on the assembly bottom surfaces 2*b* of the side seat front connectors 21, the shells 213 can be fixed to the assembly bottom surfaces 2*b* by a welding process, and the supporting base portions 2*c* are formed at bottoms of the shells 213. The extension bodies 2122 and the springs are both located inside the shells 213, wherein the extension bodies 2122 have certain lengths, and the springs sleeve the extension bodies 2122.

Figure 8:
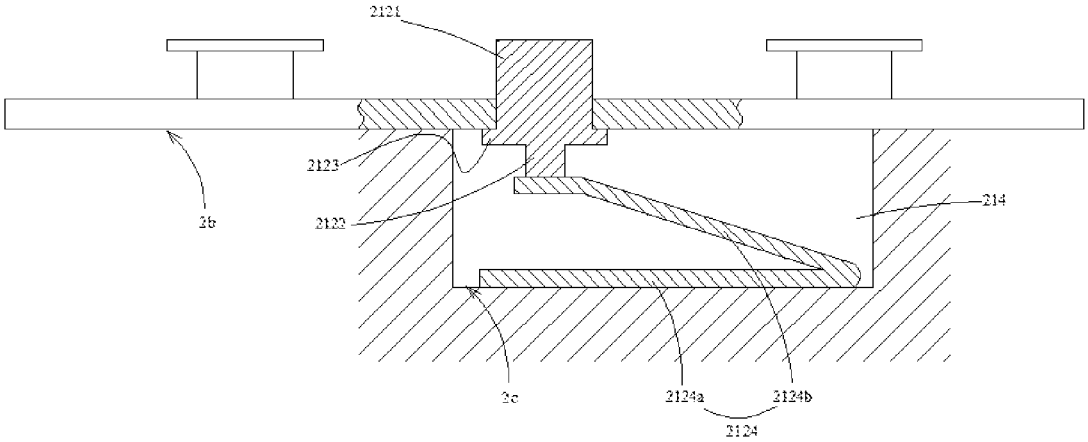
FIG. 8 is a sectional schematic diagram of a locking unit in another embodiment according to the present disclosure.

In another embodiment, referring to FIG. 8, the elastic units 2124 are arranged as sheet members which are bent to form two parts 2124*a* and 2124*b*, the parts 2124*a* are supported on the supporting base portions 2*c*, and the other parts 2124*b* support or are connected with the extension bodies 2122. In the embodiment, foundation pits 214 are formed in inner surfaces of the side frame elements 2, and the supporting base portions 2*c* are formed at bottoms of the foundation pits 214 to be used for supporting the parts 2124*a* of the sheet members. Bending degrees at bent positions of the sheet members may be increased after the sheet members are pressed, so that elastic force is supplied to the locking units 212.

Furthermore, the side seat front connectors 21 are positioned on inner surfaces of the side frame elements 2, the side seat front connectors 21 may be directly fixed to the inner surfaces of the side frame elements 2, or grooves are formed in the inner surfaces of the side frame elements 2 and then the side seat front connectors 21 are fixedly embedded into the grooves. The front seat connectors 11 include front seat connector fixing portions 11*a* and front seat connector assembly portions 11*b* connected with the front seat connector fixing portions, and the front seat connector fixing portions and the front seat connector assembly portions are integrally-formed and bent members. Wherein, the front seat connector fixing portions 11*a* are positioned on an inner surface of the front frame element 1, and the assembly fitting surfaces 1*b* are formed on the front seat connector assembly portions 11*b*. Base tables 12 formed by protruding are arranged on the inner surface of the front frame element 1, so as to increase a thickness of the front frame element 1 at the positions. The front seat connector fixing portions 11*a* are fixed to the base tables 12, thereby improving the structural strength of positions, where the front seat connector fixing portions 11*a* are arranged, of the front frame element 1.

Figure 9:
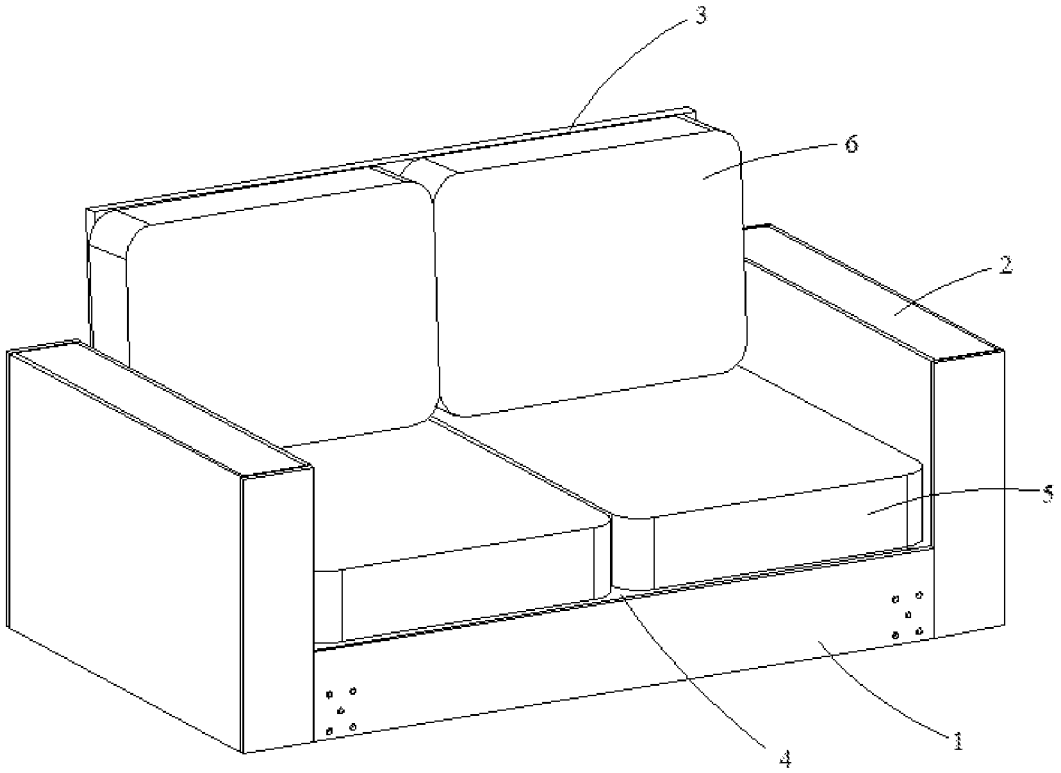
FIG. 9 is a structural schematic diagram of an assembly sofa according to the present disclosure.
Figure 10:
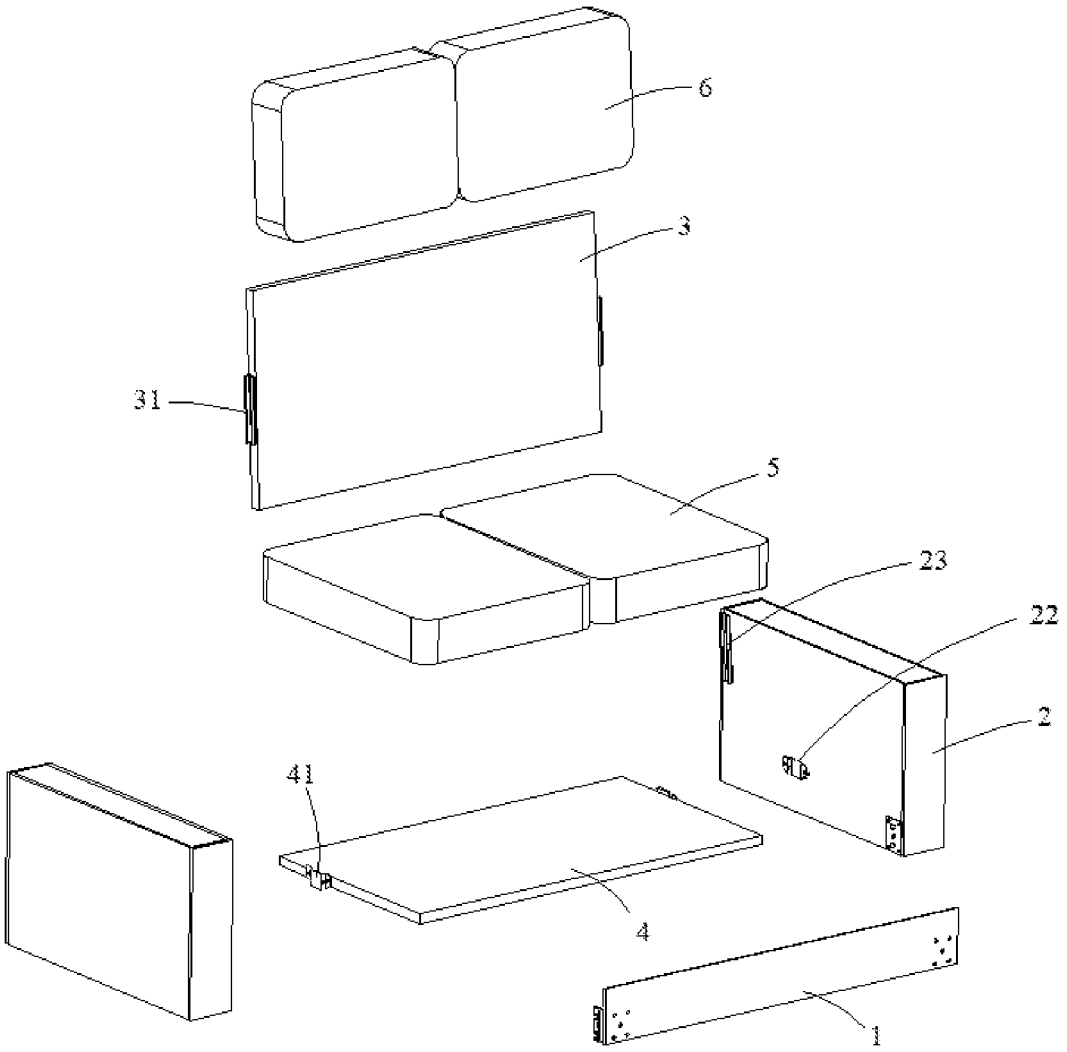
FIG. 10 is an exploded schematic diagram of an assembly sofa according to the present disclosure.

The above base may serve as the bottom foundation structure of the chair, the sofa, the bed or other seating devices, and is especially suitable for serving as the bottom foundation structure of the sofa. As shown in FIG. 9 and FIG. 10, an assembly sofa, includes the base described above, a backrest 3, backrest connectors 31 arranged on left and right sides of the backrest 3, side seat rear connectors 23 arranged on side frame elements 2 and suitable for being connected to the backrest connectors 31, a seat board 4, seat board connectors 41 arranged on left and right sides of the seat board 4, and side seat middle connectors 22 arranged on the side frame elements 2 and suitable for being connected to the seat board connectors 41.

Figure 11:
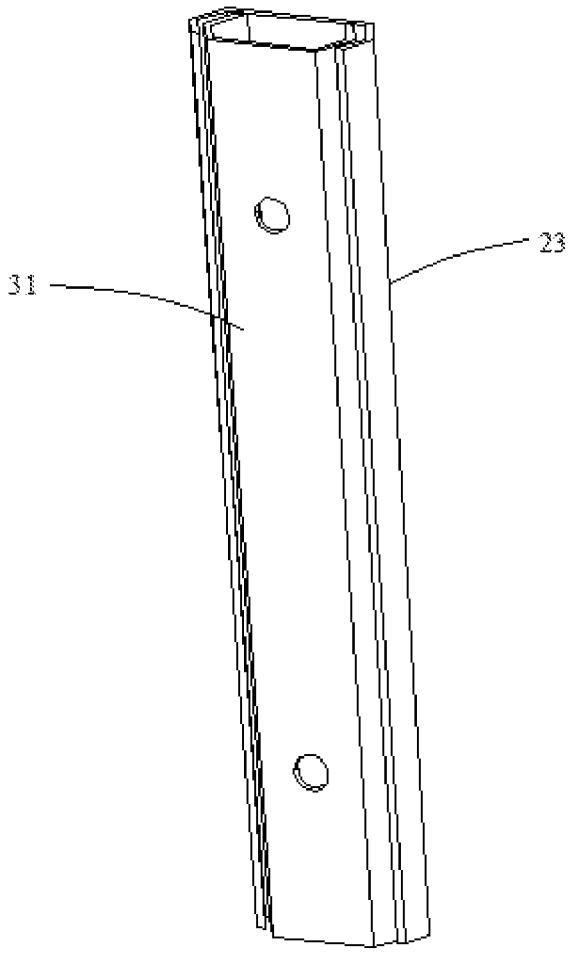
FIG. 11 is a structural schematic diagram of a side seat rear connector and a backrest connector according to the present disclosure.
Figure 12:
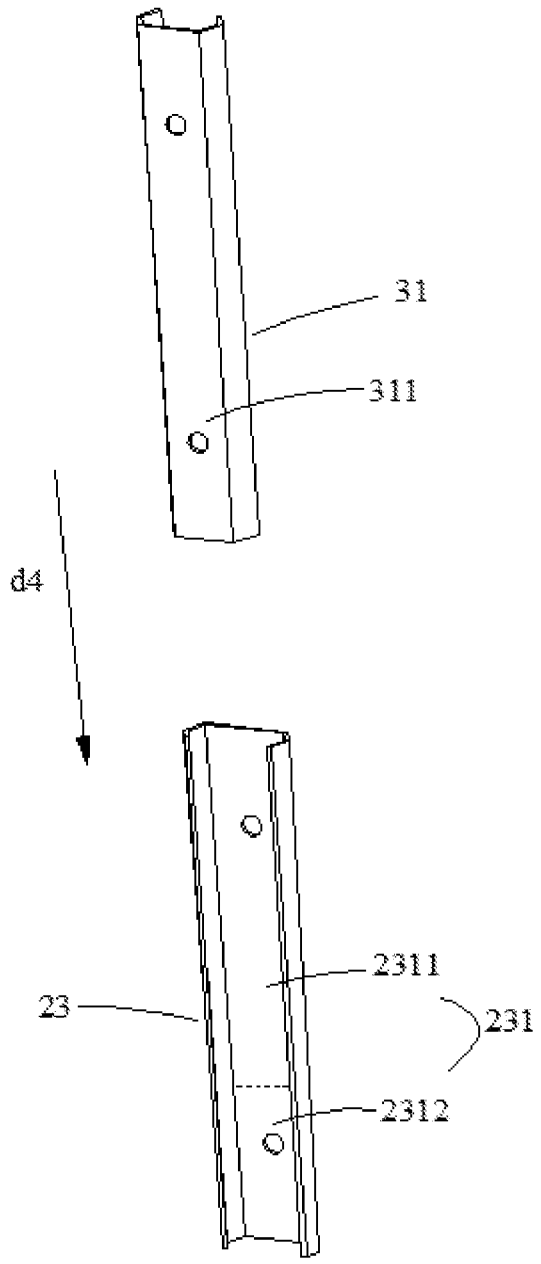
FIG. 12 is a schematic diagram of disassembly of a side seat rear connector and a backrest connector according to the present disclosure.

Referring to FIG. 11 and FIG. 12, the side seat rear connectors 23 are provided with assembly slots 231 providing an assembly guiding direction d4 matched with extension directions of the assembly slots. The assembly slots 231 include sliding portions 2311 and locking portions 2312 in the assembly guiding direction d4. The backrest connectors 31 are provided with inserting units 311 extending in the assembly guiding direction d4, and the inserting units 311 can be inserted into the assembly slots 231 in the assembly guiding direction d4 from ends of the sliding portions 2311. Portions, positioned in the assembly slots 231, of the inserting units 311 are in clearance fit with the sliding portions 2311, so that the inserting units 311 can slide in the assembly guiding direction d4. The inserting units 311 are in interference fit with the locking portions when sliding to the locking portions 2312, so that the inserting units 311 are locked on the locking portions 2312, so as to complete assembly and connection of the side seat rear connectors 23 and the backrest connectors 31. Similar to a connection and assembly manner of the side seat front connectors 21 and the front seat connectors 11, no tools or additional parts such as screws are needed for connection and assembly of the side seat rear connectors 23 and the backrest connectors 31, and the side seat rear connectors and the backrest connectors are suitable for being rapidly and conveniently assembled.

Furthermore, fit clearances of the assembly slots 231 and the inserting units 311 are gradually reduced in the assembly guiding direction d4, that is, groove widths of the assembly slots 231 from the sliding portions 2311 to the locking portions 2312 exhibit linear changes, so that an inserting process is stable, and clamping stagnation can be prevented from occurring during connection and assembly.

Figure 13:
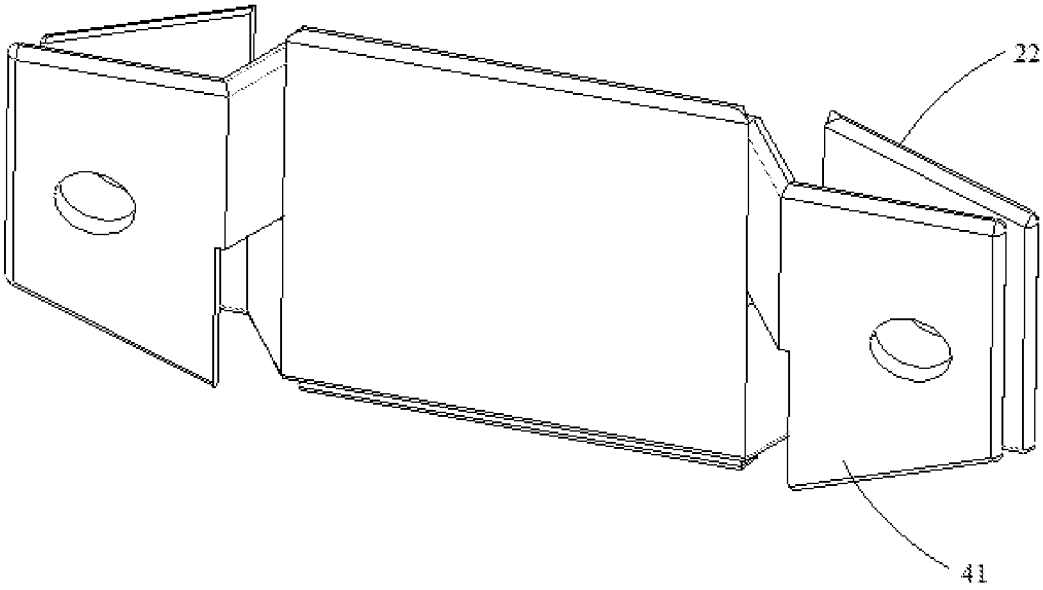
FIG. 13 is a structural schematic diagram of a side seat middle connector and a seat board connector according to the present disclosure.
Figure 14:
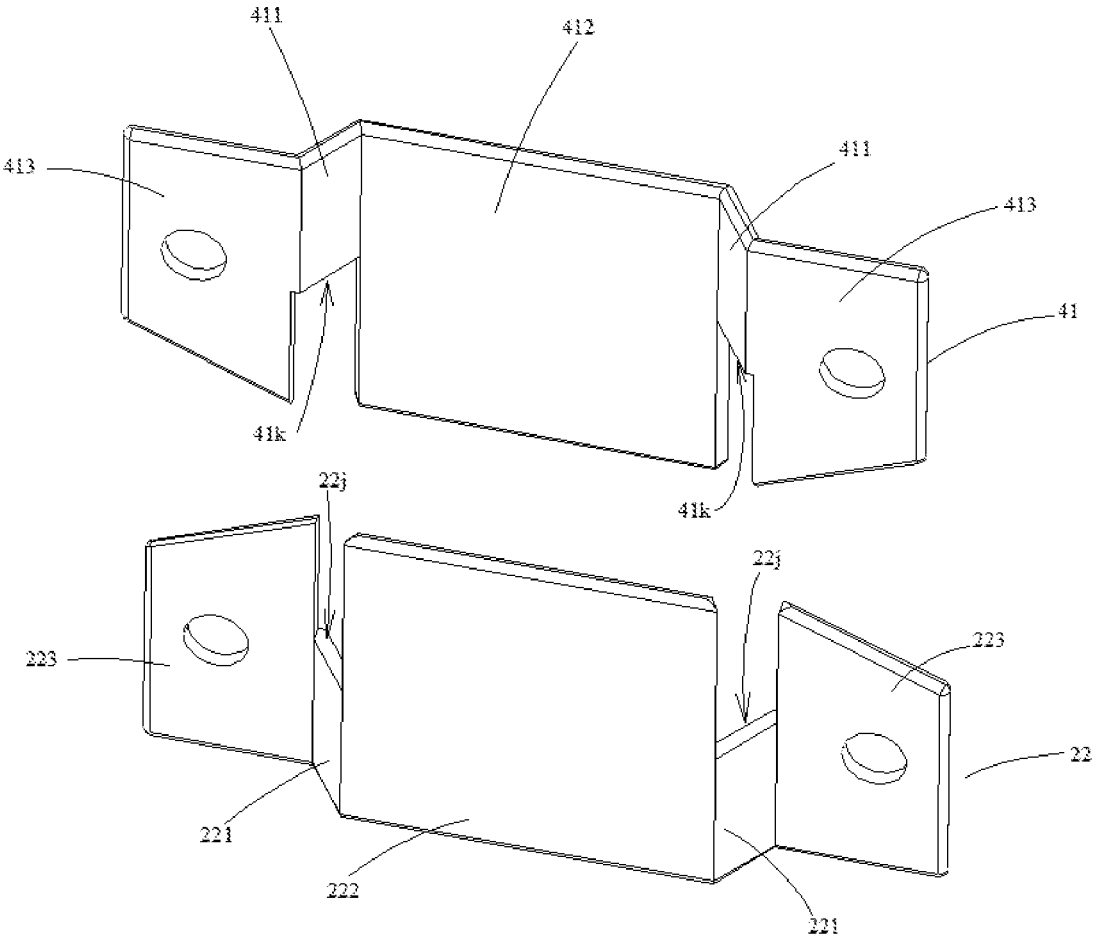
FIG. 14 is a schematic diagram of disassembly of a side seat middle connector and a seat board connector according to the present disclosure.

Referring to FIG. 13 and FIG. 14, each side seat middle connector 22 is provided with a bearing structure 22*j*, and each seat board connector 41 is provided with a supporting structure 41*k* matched with the bearing structure. The supporting structures 41*k* are supported on the bearing structures 22*j*, so that a seat is arranged between the two side frame elements 2 in a lapped manner, a direction of supporting acting force of the bearing structures 22*j* for the supporting structures 41*k* is opposite to a force applying direction of a user sitting on the seat board 4 for the seat board 4, so that the seat board 4 is stably connected, and meanwhile, the side seat middle connectors and the seat board connectors are suitable for being rapidly and conveniently assembled.

More specifically, each side seat middle connector 22 includes two bearing side portions 221 which are positioned on an inner surface of the corresponding side frame elements 2 and extend out, and a positioning portion 222 connecting the two bearing side portions 221 and forming a clearance with the inner surface of the side frame elements 2. The bearing side portions 221 and the positioning portion 222 are of integrated structures as well as vertical platy structures. Connecting seats 223 are arranged on portions, positioned on the inner surfaces of the side frame elements 2, of the bearing portions, and fixedly connected to the inner surfaces of the side frame elements 2 by fasteners. Each seat board connector 41 includes two supporting side portions 411 which are positioned on side faces of the seat board 4 and extend out. The supporting side portions 411 are of vertical platy structures, and connecting seats 413 are arranged on portions, positioned on the side faces of the seat board 4, of the supporting side portions 411, and fixedly connected to the side faces of the seat board 4 by fasteners. One supporting structure 41*k* and one bearing structure 22*j* are formed by bottoms of the two supporting side portions 411 and tops of the two bearing side portions 221 respectively, that is, the two supporting side portions 411 are supported on the two corresponding bearing side portions 221 respectively. A width of the positioning portion 222 is larger than that of the bearing side portions 221 on two sides of the positioning portion, so that the two sides of the positioning portion 222 abut against the two supporting side portions 411 respectively to limit an assembly position of each of the seat board connector 41 on the corresponding side seat middle connector 22, thereby preventing the seat board 4 from sliding front and back relative to the side frame elements 2.

Still furthermore, each seat board connector 41 further includes a connecting portion 412 connecting the two supporting side portions 411, and the two supporting side portions 411 and the connecting portion 412 are buckled on the positioning portion 222, so that the seat board connector 41 and the side seat middle connector 22 are more stably connected and assembled. When a structure of the sofa loosens after the sofa has been used for a long time, an interval between the two side frame elements 2 can be kept.

In order to further improve the stability of the seat board 4, especially to prevent overloads of the seat board connectors 41 and the side seat middle connectors 22 caused by the forward of the center of gravity of the overall seat board 4 as a user sits forwards, bearing units 13 are arranged on the inner surface of the front frame element 1, and there may be one or more bearing units 13. In one embodiment, the bearing units 13 are of long-strip-shaped structures arranged horizontally, a front portion of the seat board 4 is supported on the bearing units 13, and a second supporting point is supplied to the seat board 4, so as to relieve loads of the seat board connectors 41 and the side seat middle connectors 22.

The sofa further includes at least one seat cushion 5 laid on the seat board 4, and at least one backrest cushion 6 against the backrest 3. The number of the seat cushions 5 and the number of the backrest cushions 6 are set according to a width specification of the sofa, for example, the seat cushions 5 and the backrest cushions 6 in different numbers are set according to a single-seat sofa, a double-seat sofa and a three-seat sofa. In addition, the seat cushions 5 and the backrest cushions 6 are stored in vacuum compression packages before the assembly sofa is assembled, so as to reduce a volume proportion of each component to be packaged before the sofa is assembled.

It should be noted finally that the above embodiments are merely used for illustrating the technical solutions of the present disclosure instead of limiting them; although the present disclosure is illustrated in detail with reference to the above embodiments, those ordinarily skilled in the art should understand that they still can modify the technical solutions recorded in each above embodiment, or equivalently substitute part or all of technical features therein; and these modifications or substitutions cannot make the essence of the corresponding technical solutions depart from the scope of the technical solutions of each embodiment of the present disclosure.

What is claimed is:

1. A base, comprising a front frame element, front seat connectors arranged at left and right ends of the front frame element, two side frame elements with a preset interval, and side front connectors arranged on the side frame elements and suitable for being connected to the front seat connectors;

wherein each side front connector is provided with an assembly base surface; positioning units are arranged on the assembly base surfaces;

each front seat connector is provided with an assembly fitting surface making contact with the corresponding assembly base surface; positioning cutoffs for limiting final assembly positions of the front seat connectors on the side front connectors are arranged on the assembly fitting surfaces; and first guiding pathways and second guiding pathways for guiding the positioning units to reach the positioning cutoffs in a first assembly direction and a second assembly direction are arranged on the assembly fitting surfaces;

circuitous pathways for guiding the positioning units to reach the second guiding pathways from the first guiding pathways in a circuitous assembly direction are arranged on the assembly fitting surfaces;

the circuitous pathways are provided with circuitous inflection points, and circuitous pathway front sections and circuitous pathway rear sections are limited by the circuitous inflection points as boundaries; and the circuitous assembly direction corresponding to the circuitous pathway rear sections is consistent with the second assembly direction;

attaching walls are formed at the circuitous inflection points, which attaching walls are configured to achieve full surface contact with a portion of the position units' surface when the position units reach the circuitous inflection points;

a first assembly path limited by the first guiding pathways and the second guiding pathways and a second assembly path limited by the first guiding pathways, the circuitous pathways and the second guiding pathways coexist side by side;

curbs formed at least on sides of the first guiding pathways, the circuitous pathways and the second guiding pathways are arranged on the front seat connectors; and self-locking structures capable of abutting against the curbs and used for preventing the front seat connectors from being separated from the side seat front connectors are arranged on the positioning units;

locking units which have preset shapes and can retract after being extruded are arranged on the assembly base surfaces; and locking cutoffs which allow the locking units extruded by the assembly fitting surfaces to rebound to the preset shapes at final installation positions and are combined with the locking units are arranged on the assembly fitting surfaces.

2. The base according to claim 1, wherein the locking cutoffs comprise encircling walls formed on the assembly fitting surfaces, and rebound spaces which are limited in the encircling walls and allow the locking units to rebound to the preset shapes; and the encircling walls abut against the locking units at least in a direction opposite to the second assembly direction.

3. The base according to claim 1, wherein the locking units comprise combinations presented as preset shapes, and extension bodies which extend out of the combinations and penetrate through the side seat front connectors; each side seat front connector is provided with an assembly bottom surface opposite to the corresponding assembly base surface, and the extension bodies are provided with abutting-against structures capable of making contact with the assembly bottom surfaces, so as to completely show the combinations on the assembly base surfaces; and supporting base portions are arranged on sides, located on the assembly bottom surfaces, of the side seat front connectors, elastic units which are arranged in a retraction direction of the locking units and have an elastic compression amount are arranged on the supporting base portions, and the elastic units support the abutting-against structures or the extension bodies to make the abutting-against structures kept in a state of making contact with the assembly bottom surfaces.

4. The base according to claim 3, wherein the elastic units are arranged as springs, and their two ends are supported on the supporting base portions, the abutting-against structures or the extension bodies respectively.

5. The base according to claim 3, wherein the elastic units are arranged as sheet members which are bent to form two parts, one part of each of the sheet members is supported on the corresponding supporting base portion, and the other part supports or is connected with the corresponding extension body.

6. An assembly sofa, comprising a front frame element, front seat connectors arranged at left and right ends of the front frame element, two side frame elements with a preset interval, side front connectors arranged on the side frame elements and suitable for being connected to the front seat connectors, a backrest, backrest connectors arranged on left and right sides of the backrest, side seat rear connectors arranged on the side frame elements and suitable for being connected to the backrest connectors, a seat board, seat board connectors arranged on left and right sides of the seat board, and side seat middle connectors arranged on the side frame elements and suitable for being connected to the seat board connectors;

each side front connector is provided with an assembly base surface; positioning units are arranged on the assembly base surfaces;

each front seat connector is provided with an assembly fitting surface making contact with the corresponding assembly base surface; positioning cutoffs for limiting final assembly positions of the front seat connectors on the side seat front connectors are arranged on the assembly fitting surfaces; and first guiding pathways and second guiding pathways for guiding the positioning units to reach the positioning cutoffs in a first assembly direction and a second assembly direction and circuitous pathways for guiding the positioning units to reach the second guiding pathways from the first guiding pathways in a circuitous assembly direction are arranged on the assembly fitting surfaces; locking units which have preset shapes and can retract after being extruded are arranged on the assembly base surfaces; locking cutoffs which allow the locking units extruded by the assembly fitting surfaces to rebound to the preset shapes at final installation positions and are combined with the locking units are arranged on the assembly fitting surfaces; the locking units comprise combinations presented as preset shapes, and extension bodies which extend out of the combinations and penetrate through the side seat front connectors; each side seat front connector comprises an assembly bottom surface opposite to the corresponding assembly base surface, and the extension bodies are provided with abutting-against structures capable of making contact with the assembly bottom surfaces, so as to completely show the combinations on the assembly base surfaces;

supporting base portions are arranged on sides, positioned on the assembly bottom surfaces, of the side seat front connectors, elastic units which are arranged in retraction directions of the locking units and have an elastic compression amount are arranged on the supporting base portions, and the elastic units support the abutting-against structures or the extension bodies to make the abutting-against structures kept in a state of making contact with the assembly bottom surfaces;

the circuitous pathways are provided with circuitous inflection points, and circuitous pathway front sections and circuitous pathway rear sections are limited by the circuitous inflection points as boundaries; the circuitous assembly direction corresponding to the circuitous pathway rear sections is consistent with the second assembly direction; and a first assembly path limited by the first guiding pathways and the second guiding pathways and a second assembly path limited by the first guiding pathways, the circuitous pathways and the second guiding pathways coexist side by side.

7. The assembly sofa according to claim 6, wherein the side seat rear connectors are provided with assembly slots providing an assembly guiding direction, and the assembly slots comprise sliding portions and locking portions in the assembly guiding direction; and the backrest connectors are provided with inserting units inserted into the assembly slots in the assembly guiding direction, and the inserting units are in clearance fit with the sliding portions and in interference fit with the locking portions.

8. The assembly sofa according to claim 7, wherein fit clearances of the assembly slots and the inserting units are gradually reduced in the assembly guiding direction.

9. The assembly sofa according to claim 6, wherein the side seat middle connectors are provided with bearing structures; and the seat board connectors are provided with supporting structures supported on the bearing structures.

10. The assembly sofa according to claim 9, wherein each side seat middle connector comprises two bearing side portions which are positioned on an inner surface of the corresponding side frame element and extend out, and a positioning portion connecting the two bearing side portions and forming a clearance with the inner surface of the side frame element; each seat board connector comprises two supporting side portions which are positioned on side faces of the seat board and extend out; one supporting structure and one bearing structure are formed by the two supporting side portions and the two bearing side portions respectively, and the two supporting side portions are supported on the two corresponding bearing side portions respectively; and two sides of the positioning portion abut against the two supporting side portions respectively to limit an assembly position of the seat board connector on the side seat middle connector.

11. The assembly sofa according to claim 10, wherein each seat board connector further comprises a connecting portion connecting the two supporting side portions, and the two supporting side portions and the connecting portion are buckled on the positioning portion.

12. The assembly sofa according to claim 6, wherein bearing units are arranged on the inner surface of the front frame element, and a front portion of the seat board is supported on the bearing units.

13. The assembly sofa according to claim 6, further comprising at least one seat cushion laid on the seat board, and at least one backrest cushion against the backrest; and the seat cushions and the backrest cushions are stored in vacuum compression packages before the assembly sofa is assembled.

* * * * *